United States Patent [19]

Tseng

[11] 4,389,174

[45] Jun. 21, 1983

[54] ROTARY POWER PLANT RUNNER/SHUTTER MECHANISM

[76] Inventor: Ching-Ho Tseng, 7307 Caracas Dr., Houston, Tex. 77083

[21] Appl. No.: 222,386

[22] Filed: Jan. 5, 1981

[51] Int. Cl.[3] ..... F01C 1/324; F03C 2/00

[52] U.S. Cl. ..... 418/222

[58] Field of Search ..... 418/222, 230, 232, 244, 418/248; 123/248

[56] References Cited

U.S. PATENT DOCUMENTS

| | | | |
|---|---|---|---|
| 1,186,879 | 6/1916 | Brush | 418/222 |
| 1,611,213 | 12/1926 | Lucich | 418/222 |
| 2,069,557 | 2/1937 | Policansky | 418/222 |
| 2,584,582 | 2/1952 | Hatfield | 418/222 |

*Primary Examiner*—Craig R. Feinberg

*Assistant Examiner*—W. R. Wolfe

*Attorney, Agent, or Firm*—John F. McClellan, Sr.

[57] ABSTRACT

A rotary engine has co-acting housing affixed gate and rotor-affixed runner mechanism which automatically retract so that the runners can pass through respective portions of the gate which then automatically extend and seal so that they form between runner and gate an expansible chamber for admission of gas under pressure to cause the runner or runners to rotate the rotor; actuation to retract the gate mechanism and the runner mechanism is by contact between pivotal elements respectively engaging them as they approach each other, and expansion of each for sealing the gate mechanism centrally and for producing runner-sealing against the walls of the housing is by means of spring-bias; both symmetrical and asymmetrical embodiments are disclosed.

8 Claims, 8 Drawing Figures

ROTARY POWER PLANT RUNNER/SHUTTER MECHANISM

CROSS REFERENCE TO RELATED APPLICATION

Cross reference is made to my co-pending U.S. patent application Ser. No.: 160,628, filed June 18, 1980, for INTERNAL COMBUSTION ROTARY POWER PLANT.

FIELD OF THE INVENTION

This invention relates generally to rotary internal combustion engines and specifically to provision of a new type expansion-chamber forming mechanism for rotary internal combustion engines.

PRIOR DISCLOSURES

My aforesaid application is incorporated and made a part hereof for general content. However, it discloses a reciprocable abutment which under control of synchronous drive gearing advances generally radially against a rotor cylindrical portion across an annular chamber centered on the rotor axis to form an expansion chamber with a just-passed runner affixed on the rotor, at which point expanding gas pressure admitted to the expanding chamber drives the runner, rotating the rotor; the abutment retracts in substantially a radial direction at an appropriate place in the cycle to permit the rotor to pass. A plurality of abutments and gas supply stations, and a plurality of runners and exhausts are described, and by analogy such pluralities may be used in the present invention.

That other rotary engine art is known is exemplified by the art cited in my aforesaid application, but no art known is believed to provide the detail advantages of the present invention according to the objects set forth herein.

OBJECTS

A principal object of this invention is to provide in a rotary internal combustion engine a co-acting housing-affixed gate system and rotor-affixed runner system operable in a cylindrically annular chamber coaxial with the rotor axis, such that the gate system and the runner system collide and automatically retract sufficiently to pass each other and then under resilient bias automatically extend to form and seal-off between them an expansion chamber for admission of gas under pressure, such as ignited combustion gas, which thereupon drives the runner and thus the rotor in rotation relative to the housing; more than one gate and runner may be employed; valving of gas supply and ignition and exhaust may be by any suitable means such as those described in my aforesaid application.

Further objects are to provide a system as described which is fast acting and operates smoothly as result of paired opposite-direction reactions of operating parts of gate and runner, which is size-adaptable to suit particular needs, which employ relatively few and simple parts, which requires no external synchronization, and which is economical, sturdy and reliable.

Another object is to provide a system as described in which the elements can operate progressively as opposed to simultaneously, but sufficiently at the same time for prompt completion of each cycle.

A yet further object is to provide an alternative embodiment in which the runners may be of unequal size and the gates decentered accordingly.

BRIEF SUMMARY

In brief summary given as cursive description only and not as limitation the invention includes, in a rotary engine annular chamber, sealing gate mechanism and runner mechanism in which operational contact between gate pivotal members, and runner pivotal members which strike them and a gate block, retracts in a direction axial of the engine the gate mechanism and the runner mechanism, following which resilient means automatically extend the gate mechanism and the runner mechanism to seal again in said annular chamber.

The above and other objects and advantages of the invention will become more readily apparent on examination of the following description, including the drawings in which like reference numerals refer to like parts.

FIGS. *7a–d* are schematic plan details of different-embodiment gate arm and runner arm shapes.

Figure 8:
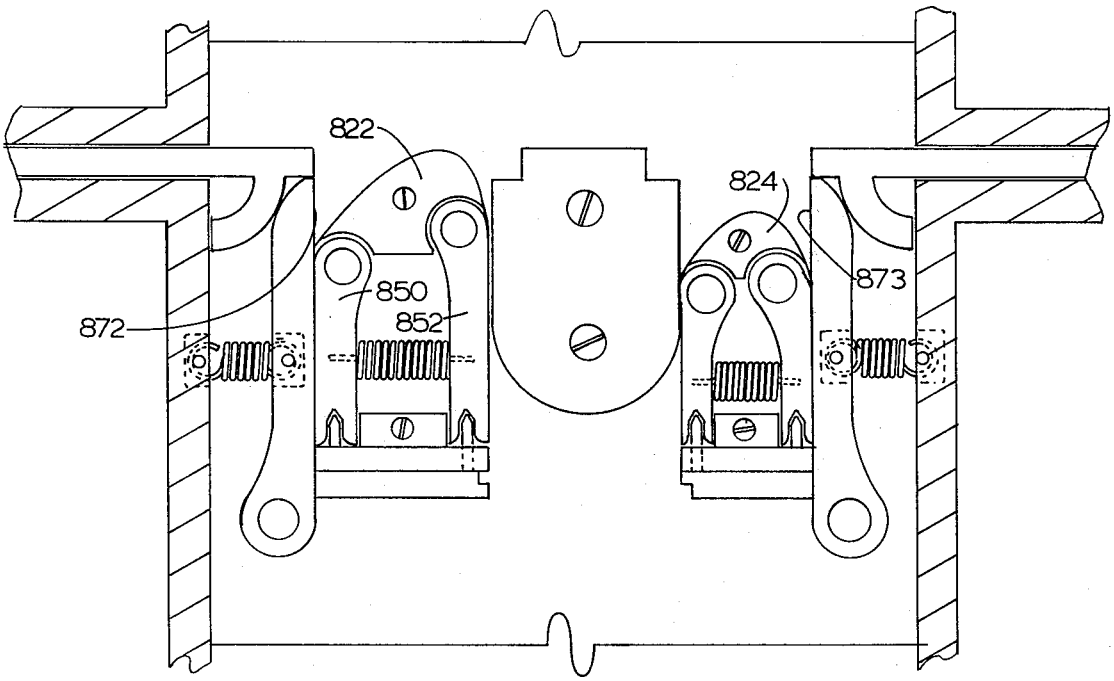

FIG. 8 describes a runner mechanism with the runners of different lengths and with different pivot placement.

DETAILED DESCRIPTION OF THE DRAWINGS

Figure 1:
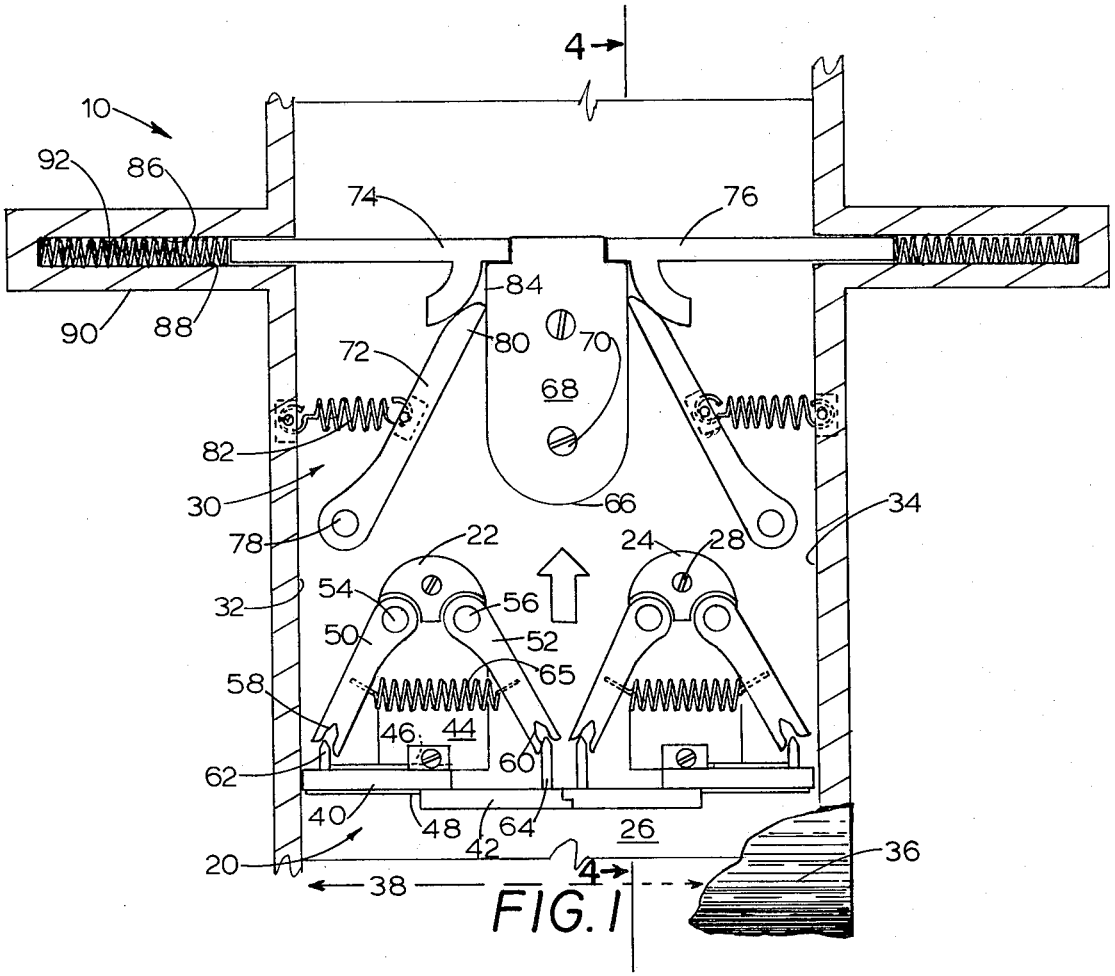
FIG. 1 diagrams in developed inwardly radial view, gate mechanism being approached by runner mechanism in an internal combustion chamber shown fragmentarily and in partial section.

FIG. 1 shows a preferred embodiment of the invention 10 in a first position of operation of a rotary internal combustion engine. At this position in the rotational cycle, runner mechanism 20, comprising first and second runners 22, 24 mounted on rotor 26 as by screws 28, is advancing as result of rotor rotation (arrow) towards gate mechanism 30.

The rotor periphery is in sealing moving engagement on the sides between the respective first and second sidewalls 32, 34 of the housing and with the cylindrical rotor 26 and interior of housing cylindrical outer wall 36 concentric with the rotor and spaced from it, form an annular chamber 38 containing the runner mechanism 20 and the gate mechanism 30.

Outboard and inboard shutters 40, 42 are slidably mounted on each runner body 44 by conventional dovetail structure 46, 48, which holds them to the runner body and to each other but permits extending and retracting movement to seal against the housing sidewalls 32, 34 and to retract from them to a compactly overlapped position at the rear of the body 44 for passing through gate mechanism 30. The shutters are full height in the annular chamber so that they seal at the top and bottom edges of the shutters.

As will be seen, shutter pivot arms 50, 52, one along each lateral margin of the shutter body 44 and respectively pivoted forwardly at 54, 56 to it, have respectively forked rear ends 58, 60, coupling to respective lugs 62, 64, on the respective shutters. These arms retract the shutters when lateral protrusion of the arms to the sides of the body strikes respective gate-mechanism portions. A respective compression spring 65 biases each pair of shutter arms apart, resiliently urging the shutters to annular chamber sealing position. Posts 54, 56 may conventionally have heads like bolts and may be force fitted into suitable holes in the body with arm countersunk holes receiving the heads.

The inboard shutter arms 52 strike the rounded rear end 66 or upstream portion of gate block 68, which is radially outwardly affixed by recessed bolts 70 to the cylindrical outer wall 36 of the housing and seals against the top, and retract. Each outboard shutter arm 50 strikes a respective gate arm 72 and retracts, and assists in holding the gate arms, and thus the gates, in open position with abutments 74, 76 retracted.

As with the runners, the gate mechanism 30 may be symmetrical about the centerline, and preferably is, but need not be. One runner may be smaller and the gate block correspondingly decentered.

Each gate arm in abutment-closed position inclines from a respective pivot 78 at the rear or upstream end where the pivot affixes to the housing outer wall 36, inwardly toward the free end or downstream end 80 which rests under bias of a tension spring 82 against the inner or concave face of a respective arcuate flange 84, an integral protrusion from each respective abutment 74, 76.

Figure 2:
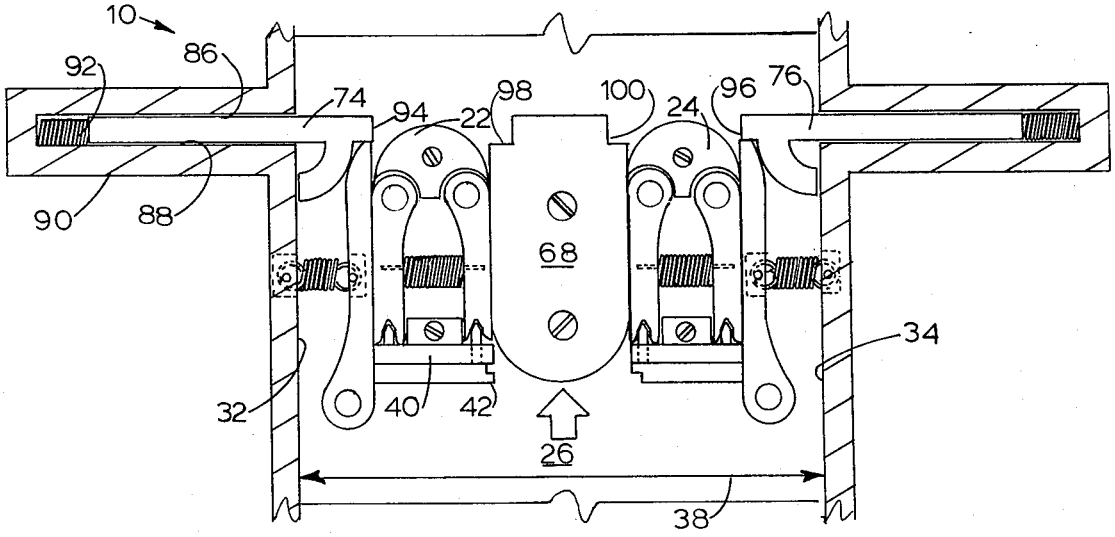
FIG. 2 diagrams a successive position of the FIG. 1 showing.

FIG. 2 shows the successive position, in which the runners 22, 24 have by advancing into operative contact with the gate mechanism, automatically retracted the shutters and the abutment. As shown here runner contact has pivoted the abutment arms to downstream orientation in retracting them, and has retracted the shutters 40, 42 to a compactly overlapped configuration at the rear end of each respective runner.

Each abutment 74, 76 has an outer portion 86 that slides axially of the rotor axis across the annular chamber, to extend, and to retract to the position shown, in a slot 88. Each abutment is full height in the annular chamber so that it seals at top and bottom of the shutter. Each slot is in a thickening 90 in a respective one of the housing axial walls 32, 34 which bound the sides of the cylindrically annular chamber 38 which, as said, the runner mechanism and the gate mechanism can partition into an expansion chamber between them for receiving the expanding gas to drive the runner and thus the rotor on which the runner is affixed.

A compression spring 92 within each slot, or other conventional means, is provided to bias each of the first and second abutments towards the other. In the closed position each of the abutment inner ends 94, 96, comes to rest in and is supported in a respective notch 98, 100 in the downstream end of the gate block 68.

Figure 3:
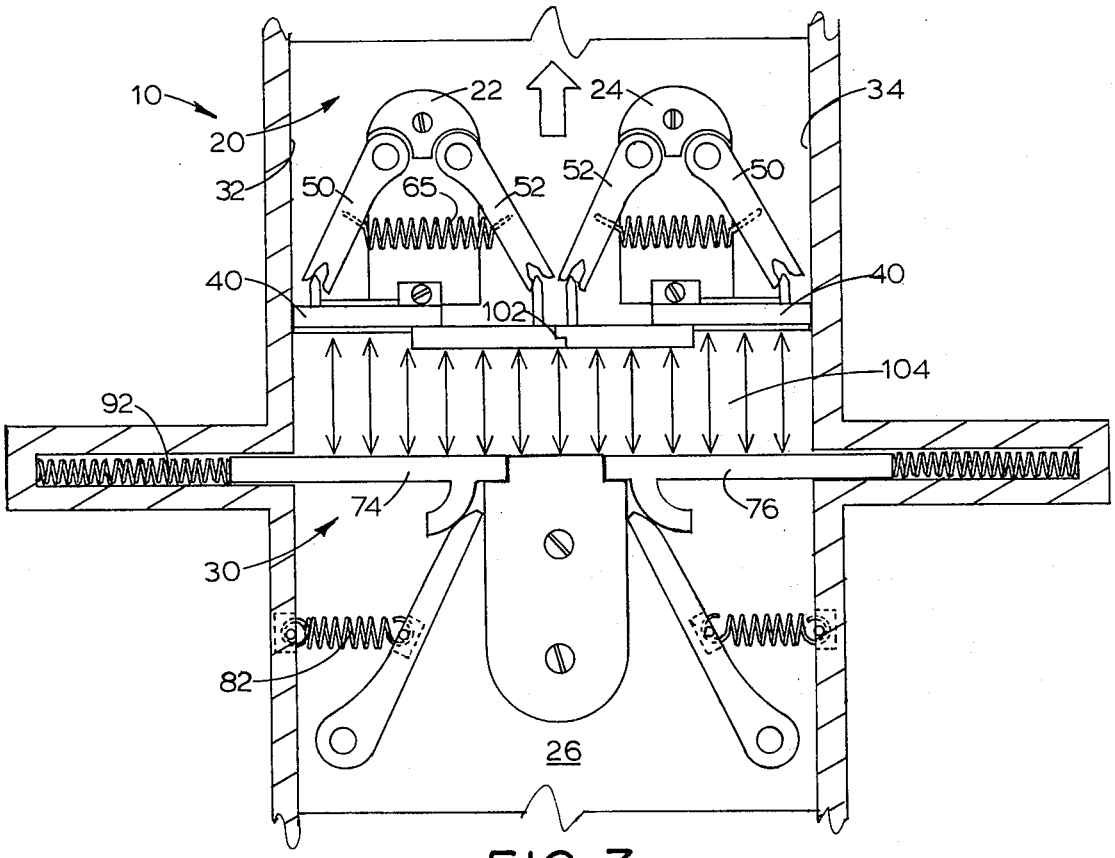
FIG. 3 diagrams a further successive position.

FIG. 3 shows a successive or firing position in which the runners 22, 24 have passed through the gate mechanism 30. The outboard shutters 40, released from contact with the gate mechanism 30 have slid outward, to sealing contact with the housing sidewalls 32, 34 under bias of the springs 65 acting on the shutter arms 50.

Similarly, and under the same bias, the inboard shutters 52 have slid inward to sealing contact with each other, in partial overlap at complementary stepped or notched structure 102 on the inboard end of each inboard shutter.

Similarly also, the abutments 74, 76 have been biased closed against the gate block by the conventional compression springs 92 which are made much stronger than contact-maintaining tension springs 82 between the gate arms and the housing. Expanding gas, admitted into expansion chamber 104 temporarily formed by and between the runner and the gate mechanisms 20, 30, forces the runner mechanism away from the gate mechanism and rotates the rotor 26 (arrows).

Figure 4:
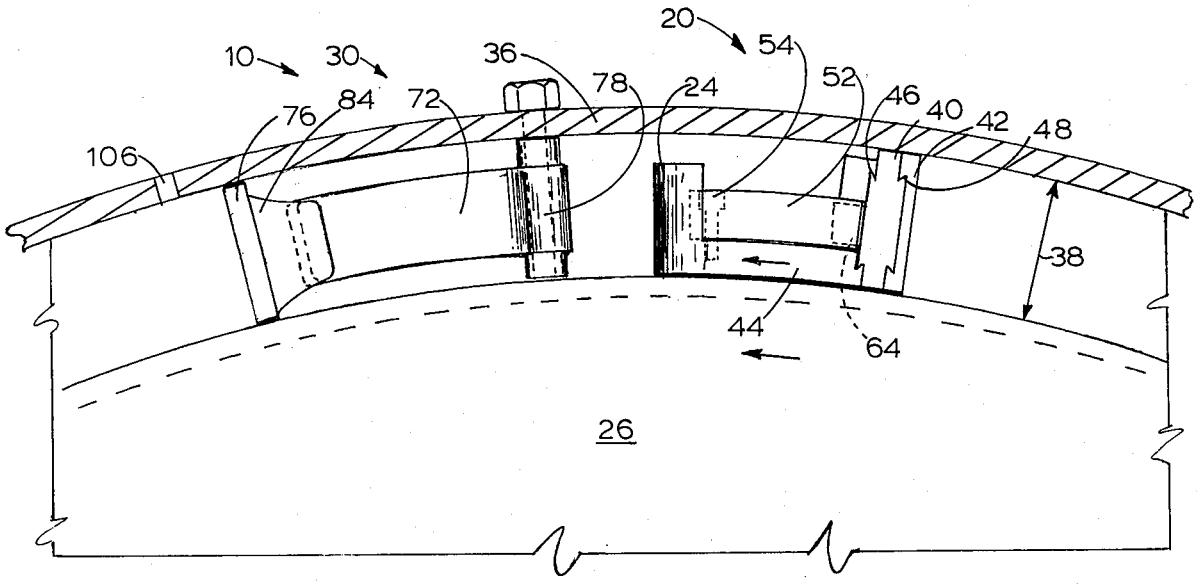
FIG. 4 diagrams in side elevational view the FIG. 1 showing.

FIG. 4 diagrams relations of the parts in fragmentary detail and idealized section generally adapted from 4—4, FIG. 1, and shows additionally at aperture 106 in the housing outer wall 36, a provision for introducing expanding gases between the gate mechanism 30 and the runner mechanism 20 after the runner mechanism has passed through the gate mechanism. The arrows show direction or rotation of rotor 26.

Abutment 76 has arcuate flange 84 in contact with gate arm 72 which pivots to the housing outer wall 36 at 78.

Runner 24 bears outboard shutter 40 and inboard shutter 42 slidably held in assembly to it and to each other by conventional dovetail slot or gripping tongue and groove structure 46, 48. Runner arm 52 pivoted forwardly in the runner body at 54 operatively engages lug 64 on shutter 40. The runner body 44 secures to the rotor 26, but is less than full height in the annular chamber 38, in contrast with the abutments and the shutters.

Figure 5:
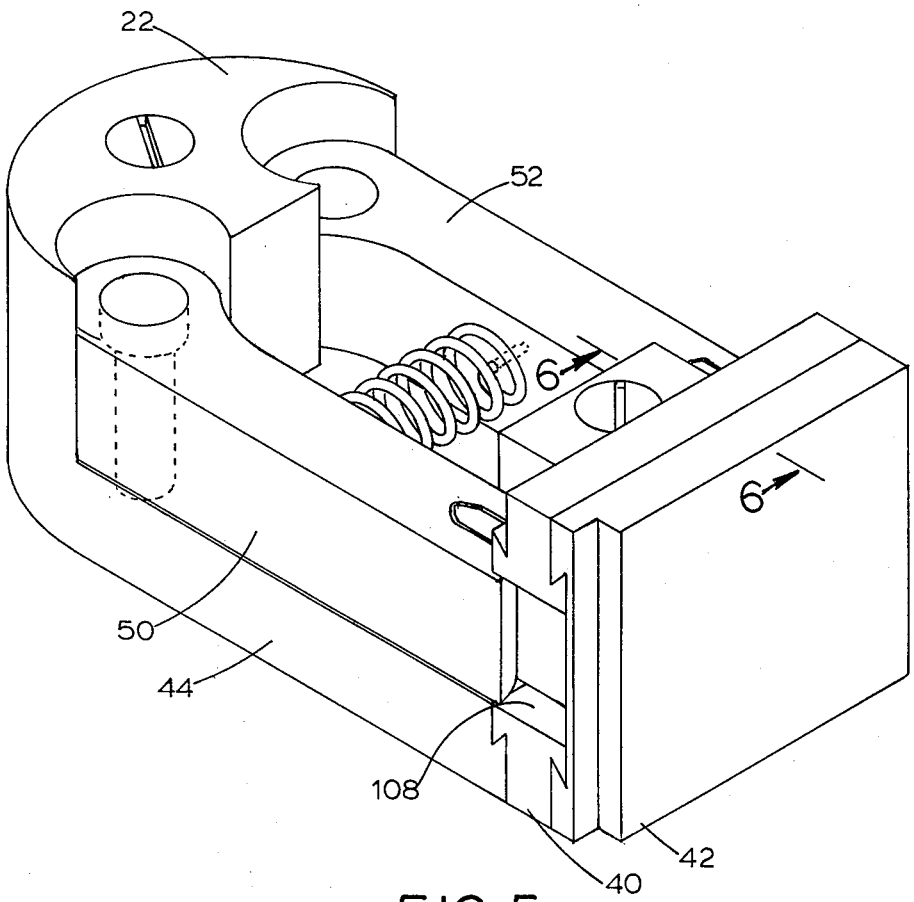
FIG. 5 is a perspective diagrammatic view of a representative form of runner.

FIG. 5 like the previous Figure diagrams one form which the runners (22 shown) can take, with the shutter arms 50, 52 in respective recesses 108 in the body 44 for balance of forces in actuating the shutters 40, 52. Radial curvature of this subassembly is omitted here for simplicity of showing.

Figure 6:
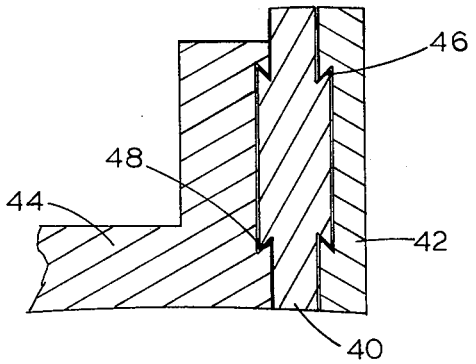
FIG. 6 is a sectional detail taken at 6—6, FIG. 5.

FIG. 6 is a sectional representation taken at 6—6, FIG. 5 and shows relations of typical dovetail structure 46 and 48 to shutters 40 and 42, and to body 44.

Figure 7:
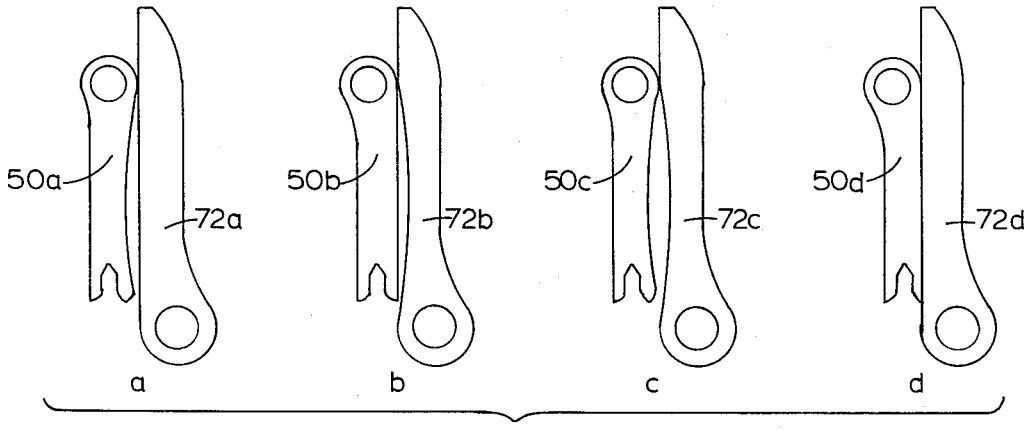

FIG. 7 diagrams various shapes the shutter pivot arms may have relative to the gate arms.

As at "a" the opposed surfaces may be respectively concave for arm 50*a* and straight for arm 72*a*; as at "b" they may be straight for arm 50*b* and concave for arm 72*b*; as at "C", 50*c* and 72*c*, they may both be concave; and as at "d", 50*d* and 72*d*, they may both be straight. In each case a different arm-acceleration curve is yielded by the always-protrusive shutter arm 50 (and the other shutter arm) when contacting the arms 72 (and the other gate arrows).

Finally, showing the versatility of the invention, FIG. 8 diagrams an embodiment 800 in which the runners 822, 824 may be asymmetrical at the front or first arm-engaging portion and/or in relative size, with the shutter arms 850, 852 for example, of differing lengths and pivot placement and the gate arms at 872, 873 of differing operating contours. Other aspects are generally as described before. This demonstrates various ways in which operation of parts may be advanced or delayed relative to other parts.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a rotary engine having: an axis, a housing with first and second sidewalls joined by a cylindrical outer wall concentric with said axis: a shaft, a rotor on the shaft with the rotor periphery fitting between the first and second sidewalls, in spaced relation with said cylindrical wall forming a generally annular chamber; runner structure on the rotor, means on the housing reciprocable for forming periodically in the annular chamber an expansion chamber in coaction with the runner structure, and means causing gas expansion in said expansion chamber for urging said runner structure to move the rotor in a forward rotational direction, the improvement comprising: a gate including the reciprocable means comprising first and second abutments slidable respectively in the first and second sidwalls and having respective inboard ends in opposed relation across said annular chamber, means permitting the runner structure to pass through the gate including means for retracting the first and second abutments into respective slots in the first and second sidewalls on approach of the runner structure, the runner structure including shutter structure; means causing the gate to seal across the annular chamber after passage of the runner structure through the gate, means causing the runner structure to seal across the annular chamber after the passage of the runner structure through the gate; the means for retracting including: first and second gate arms with pivotal attachment to the housing, first means engaging the first gate arm with the first abutment, second means engaging the second gate arm with the second abutment, means on the runner structure for pivoting said first and second gate arms, a gate block on the housing between the first and second abutments, provision on the gate block for supporting said inboard ends of the first and second abutments, the runner structure including a first runner located for passing on a first side of the gate block and a second runner located for passing on a second side of the gate block, and the means for pivoting the first and second gate arms including a respective rounded front portion on each of said runners.

2. In a rotary engine as recited in claim 1, said first means engaging including a flange projecting from said first abutment, said first gate arm having a free end at said flange projecting from the first gate arm, means biasing said free end of the first gate arm outwardly against said flange projecting from said first abutment; said second means engaging including a flange projecting from said second abutment, said second gate arm having a free end at said flange projecting from said second abutment, and means biasing said free end of the second gate arm outwardly against said flange projecting from said second abutment.

3. In a rotary engine as recited in claim 2, the means causing the gate to seal including means biasing said abutments toward said gate block.

4. In a rotary engine as recited in claim 1, the means causing the runner structure to seal including a shutter mechanism on each runner.

5. In a rotary engine as recited in claim 4, each runner having a body, each shutter mechanism including: first and second shutters, slidable retention means holding the first and second shutters in overlapping assembly to each other and to said body, means extending each first shutter outboard into contact with a respective sidewall of said first and second sidewalls and extending the respective second shutters inboard into contact with each other.

6. In a rotary engine as recited in claim 5, said contact of the second shutters including an overlap.

7. In a rotary engine as recited in claim 5, said means extending including on each runner an outbard shutter arm and an inboard shutter arm, each shutter arm having a forward and a rearward end, means pivoting each shutter arm on the forward end to the runner body, means coupling the rearward end of each shutter arm to a respective shutter and means on each runner biasing apart the outboard shutter arm and inboard shutter arm to a position with a portion of each said shutter arm protruding laterally beyond the runner body.

8. In a rotary engine as recited in claim 7, the means for retracting the shutter structure including each said outboard shutter arm protrusion proportioned for striking in passing a respective gate arm and each said inboard shutter arm protrusion proportioned for striking in passing said gate block.

* * * * *